US008957931B2

(12) United States Patent
Amano et al.

(10) Patent No.: US 8,957,931 B2
(45) Date of Patent: Feb. 17, 2015

(54) PRINTING APPARATUS

(71) Applicant: Toshiba Tec Kabushiki Kaisha, Tokyo (JP)

(72) Inventors: Yasuo Amano, Shizuoka (JP); Tsuyoshi Sanada, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/198,266

(22) Filed: Mar. 5, 2014

(65) Prior Publication Data

US 2014/0253660 A1 Sep. 11, 2014

(30) Foreign Application Priority Data

Mar. 5, 2013 (JP) ..... 2013-042823

(51) Int. Cl.

| | |
|---|---|
| ***B41J 11/00*** | (2006.01) |
| ***B41J 11/66*** | (2006.01) |
| ***B41J 13/00*** | (2006.01) |
| ***B41J 13/036*** | (2006.01) |
| ***B41J 13/10*** | (2006.01) |
| ***B41J 15/04*** | (2006.01) |
| ***B41J 15/00*** | (2006.01) |

(52) U.S. Cl.

CPC ..... *B41J 13/0036* (2013.01); *B41J 13/036* (2013.01); *B41J 13/106* (2013.01); *B41J 15/046* (2013.01); *B41J 15/005* (2013.01)

USPC ..... 347/218

(58) Field of Classification Search

USPC ..... 347/104, 218

See application file for complete search history.

(56) References Cited

U.S. PATENT DOCUMENTS

| | | | | |
|---|---|---|---|---|
| 6,229,983 | B1 * | 5/2001 | Sawada | 399/385 |
| 6,428,226 | B1 | 8/2002 | Suzuki et al. | |
| 7,458,407 | B2 * | 12/2008 | Takahashi et al. | 156/359 |
| 2003/0151652 | A1 * | 8/2003 | Shima et al. | 347/102 |

FOREIGN PATENT DOCUMENTS

| | | | | |
|---|---|---|---|---|
| EP | 1013456 | * | 6/2000 | B41J 11/70 |
| JP | H11-123850 | A | 5/1999 | |

* cited by examiner

*Primary Examiner* — Huan Tran

(74) *Attorney, Agent, or Firm* — Patterson & Sheridan, LLP

(57) ABSTRACT

A printing apparatus includes a platen roller that configured to convey a sheet, a printing head disposed opposite the platen roller, a cutter configured to cut the sheet conveyed from the platen roller, a sheet guide disposed so as to guide a portion of the sheet that has passed the cutter, a feed roller configured to rotate and convey the sheet from the cutter between the feed roller and the sheet guide and stop rotating when a portion of the sheet is nipped between the feed roller and the sheet guide, and an adjusting mechanism configured to set a distance between the sheet guide and the feed roller.

19 Claims, 4 Drawing Sheets

PRINTING APPARATUS

CROSS-REFERENCE TO RELATED APPLICATION

This application is based upon and claims the benefit of priority from Japanese Patent Application No. 2013-042823, filed Mar. 5, 2013, the entire contents of which are incorporated herein by reference.

FIELD

Embodiments described herein relate to a printing apparatus that cuts a sheet and ejects a portion of a printed portion of the sheet.

BACKGROUND

One type of a printing apparatus used for issuing receipts, tickets, and the like, prints an image on a portion of a sheet drawn out of a rolled sheet, cuts out the printed portion from the rolled sheet, and ejects the cut-out portion.

When the portion of the sheet is ejected before the sheet is cut off, a user may grasp and pull the ejected portion, or obstruct ejection of the sheet by covering the ejection outlet with his or her hand. This may cause printing failure or cutting failure, and, in some cases, may damage a cutting mechanism of the printing apparatus. In order to prevent this, one type of such a printing apparatus keeps the entire portion of the sheet to be ejected inside the printing apparatus until the printing and cutting of the sheet is completed, and ejects the sheet to the user after the sheet is cut off.

In such a printing apparatus, a printed portion of the sheet forms a loop therein. However, properly forming the loop in the printing apparatus is difficult because the loop is formed differently depending on the type of the sheet. Some types of sheets may even cause a jam.

DETAILED DESCRIPTION

In general, according to one embodiment, a printing apparatus includes a platen roller configured to convey a sheet, a printing head disposed opposite the platen roller, a cutter configured to cut the sheet conveyed from the platen roller, a sheet guide disposed so as to guide a portion of the sheet that has passed the cutter, a feed roller configured to rotate and convey the sheet from the cutter between the feed roller and the sheet guide and stop rotating when a portion of the sheet is nipped between the feed roller and the sheet guide, and an adjusting mechanism configured to set a distance between the sheet guide and the feed roller.

Hereinafter, a printing apparatus according to a first embodiment will be described in detail with reference to the drawings.

First Embodiment

Figure 1:
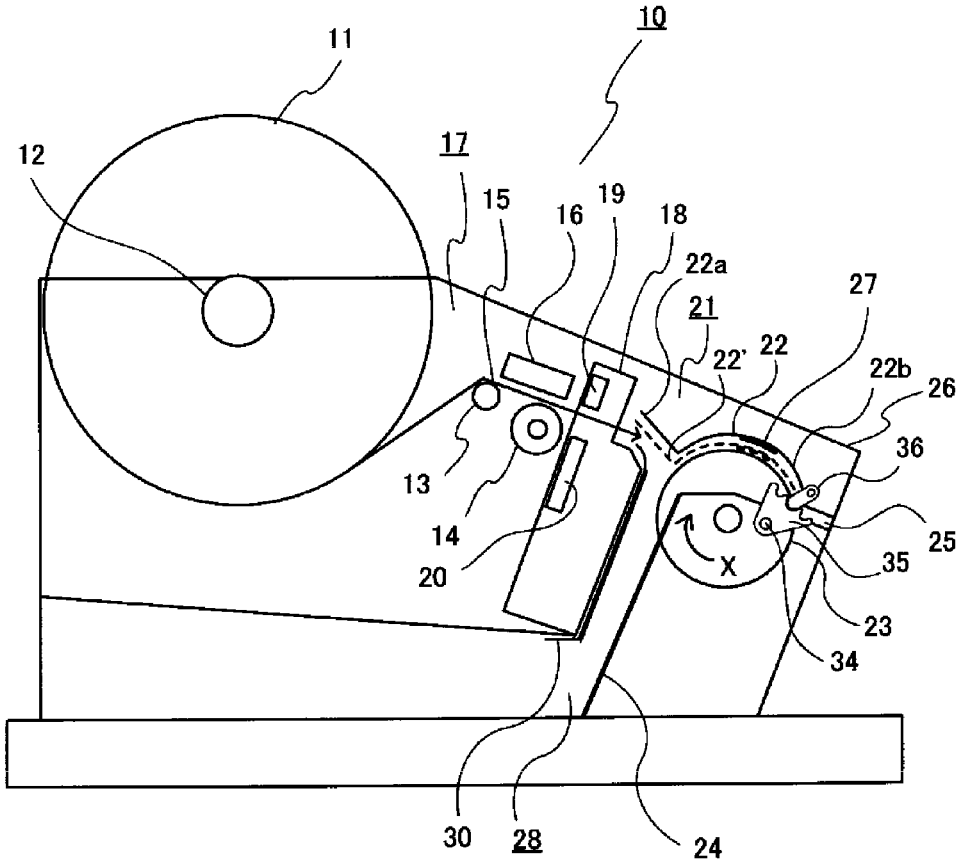
FIG. 1 is a schematic diagram illustrating various components of a printing apparatus according to a first embodiment.

FIG. 1 shows various components of a printing apparatus 10 integrally combined with a sheet ejection mechanism. In the printer, an end of a sheet 11 is fed from the left side to the right side in FIG. 1, and thus in the following description, the left side in the FIG. 1 is referred to as an upstream side, and the right side is referred to as a downstream side. In FIG. 1, reference numeral 11 denotes the sheet wound around a spool 12 and held in a rolled state. The spool 12 is rotatably supported in the printing apparatus 10. An idle roller 13 is rotatably supported downstream with respect to the rolled sheet 11 in a sheet feeding direction. Further downstream in the sheet feeding direction, a platen roller 14 configured to be driven by a motor is disposed, and a thermal printing head 16 is disposed opposite to the platen roller 14 across a sheet feeding path 15. The platen roller 14 and the thermal printing head 16 constitute a printing unit 17. The thermal printing head 16 prints an image line by line in accordance with the feeding of the sheet 11 while the sheet 11 is fed downstream along the sheet feeding path 15. The thermal printing head 16 is pressed by the platen roller 14 to feed the sheet 11 downstream by friction between the thermal printing head 16 and the platen roller 14.

A cutter 18 is disposed downstream in the sheet feeding direction with respect to the printing unit 17. The cutter 18 includes a stationary blade 19 and a movable blade 20. The cutter 18 cuts the sheet 11 at a portion located in a slit (not shown) of the cutter 18 by sliding the movable blade 20 by a driving of a motor (not shown) toward the stationary blade 19.

Here the cutter 18 is a so-called slide cutter in which the movable blade 20 slides toward the stationary blade 19, but the cutter 18 is not limited to this. The cutter 18 may be a so-called rotary cutter in which a movable blade rotates with respect to a stationary blade to cut the sheet.

Downstream with respect to the cutter 18, a loop forming mechanism 21 is disposed so as to keep the sheet 11 to be contained inside the printing apparatus 10 by bending the sheet 11 in a loop shape until printing and cutting of the sheet 11 are completed. Here the loop forming mechanism 12 includes an upper sheet guide 22 and a feed roller 23. The upper sheet guide 22 has a first guide portion 22*a* in a flat shape and a second guide portion 22*b* in an arc shape. A protruding portion 27 is provided between a second guide portion 22*b* of the upper sheet guide 22 and the feed roller 23. The protruding portion 27 is provided to continuously contact the feed roller 23 unless the sheet 11 is fed therebetween. The protruding portion 27 and the feed roller 23 hold the sheet 11 fed therebetween.

A guide cam 35 is connected to a rotation center 34, which is attached to a frame (not shown) of the printing apparatus 10, and rotationally movable around the rotation center 34. The guide cam 35 is rotated by a motor (not shown). A guide circular disc 36 is provided at an end of the upper sheet guide 22. The integral upper sheet guide 22 and the guide circular disc 36 are urged toward the guide cam 35 by an urging mechanism (not shown). Thereby, the guide cam 35 is continuously in contact with the guide circular disc 36.

Below the upper sheet guide 22, a lower sheet guide 24 extending downward in the printing apparatus 10 is provided. A side sheet guide 30 is provided opposite to the lower sheet guide 24. An ejection opening 25 is provided downstream with respect to the feed roller 23 in the printing apparatus 10.

A loop retraction space 28 is provided in a lower part of the printing apparatus 10.

A printer cover 26 covers the idle roller 13, the platen roller 14, the thermal printing head 16, the cutter 18, the upper sheet guide 22, the feed roller 23, the lower sheet guide 24, and the ejection opening 25 in the printing apparatus 10.

A display unit 37 described below is disposed in the printing apparatus 10. The display unit 37 displays conditions of the printing apparatus such as sheet out, a sheet jam, and error indications of the printing apparatus 10, and has sheet thickness buttons 38 described below for setting an operation mode related to sheet thickness.

Figure 2:
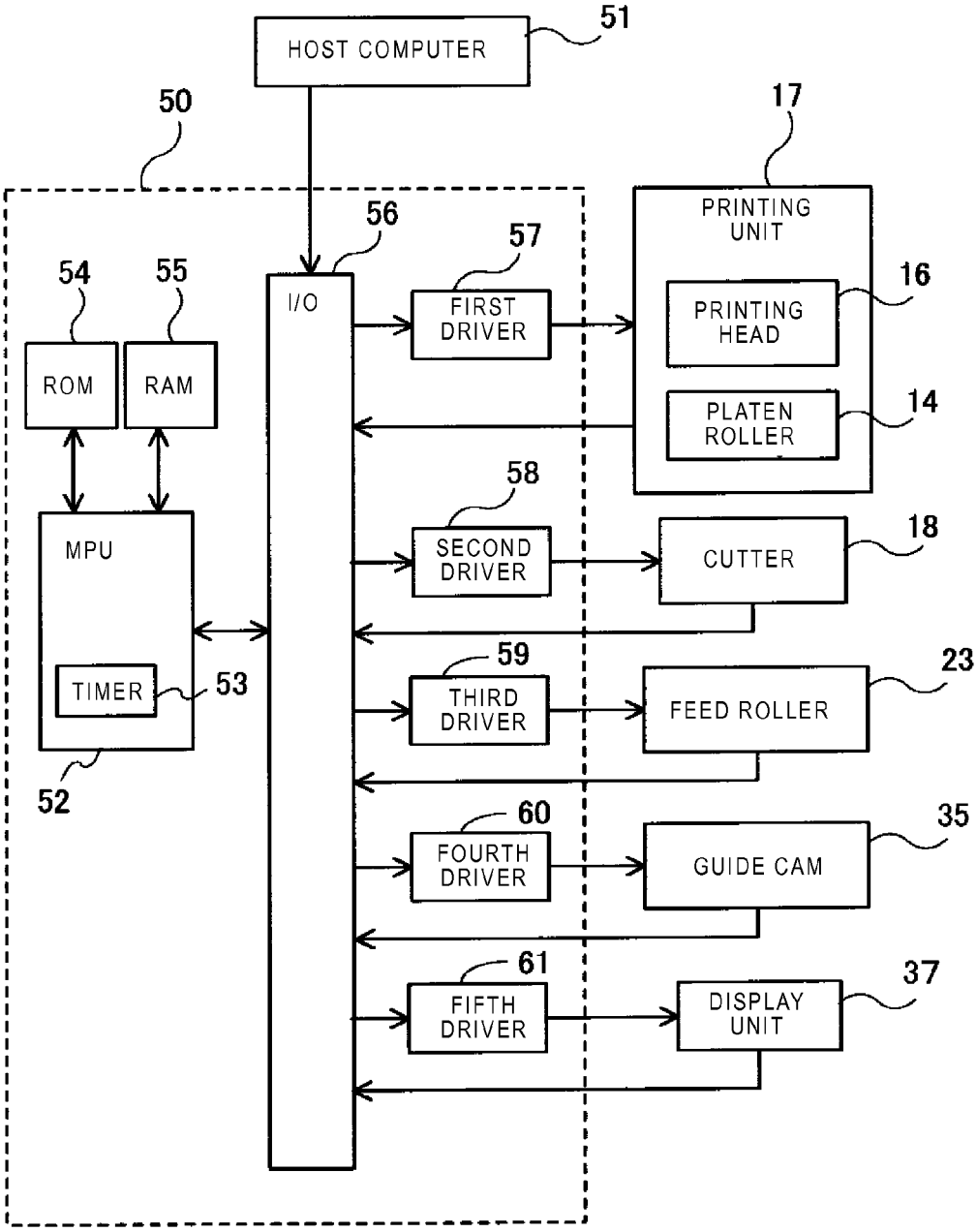
FIG. 2 is a block diagram illustrating a control circuit of the printing apparatus according to the first embodiment.

FIG. 2 shows a controller 50 of the printing apparatus 10. The controller 50 includes units that control a sheet feeding operation, a printing operation, a sheet cutting operation, and a sheet ejecting operation.

The controller 50 includes a microcomputer, for example, which interconnects with a host computer 51 and executes various kinds of operations. A microprocessor unit (MPU) 52 of the controller 50 controls operations such as the a sheet feeding operation, the printing operation, the sheet cutting operation, and the sheet ejection operation in accordance with programs. The MPU 52 has a timer 53 as a unit that performs a time setting and a time control.

A ROM 54 and a RAM 55 are provided as main storage units for storing control programs executed by the MPU 52, temporary data for the control programs or operations, and the like. The ROM 54 is a read-only memory for storing the control programs, tables, and the like. The RAM 55 is a random access memory for storing the temporary data for the operations and the like.

The controller 50 also includes an input-output unit (I/O) 56 for taking in various kinds of input data out of the host computer 51, and providing out control outputs from the controller 50 to the host computer 51. The I/O 56 is interconnected to the MPU 52, the ROM 54, and the RAM 55 through buses.

The I/O 56 is connected to first, second, third, fourth, and fifth drivers 57, 58, 59, 60, and 61 to which control outputs are supplied. The driver 57 supplies a necessary drive output to the printing portion 17. The driver 58 supplies a drive output to the cutter 18. The driver 59 supplies a drive output to the feed roller 23. The driver 60 supplies a drive output to the guide cam 35. The driver 61 supplies a display drive output to the display unit 37 to cause the display unit 37 to display various indications.

The printing unit 17 includes the thermal printing head 16 and the platen roller 14 illustrated in FIG. 1. Based on a control output as a print command from the MPU 52, the platen roller 14 is driven to rotate in synchronization with printing operation by the motor (not shown). Based on printing data output from the host computer 51, the thermal printing head 16 prints an image on the sheet 11.

The MPU 52 in the controller 50 controls the driver 58 to cause the cutter 18 to cut the sheet 11.

The MPU 52 in the controller 50 controls the driver 59 to cause the feed roller 23 to rotate and stop.

The MPU 52 in the controller 50 controls the driver 60 to cause the guide cam 35 to rotate into a specified position.

The MPU 52 in the controller 50 controls the driver 61 to cause the display unit 37 to display various conditions, error descriptions, and the like of the printing apparatus 10.

Figure 3:
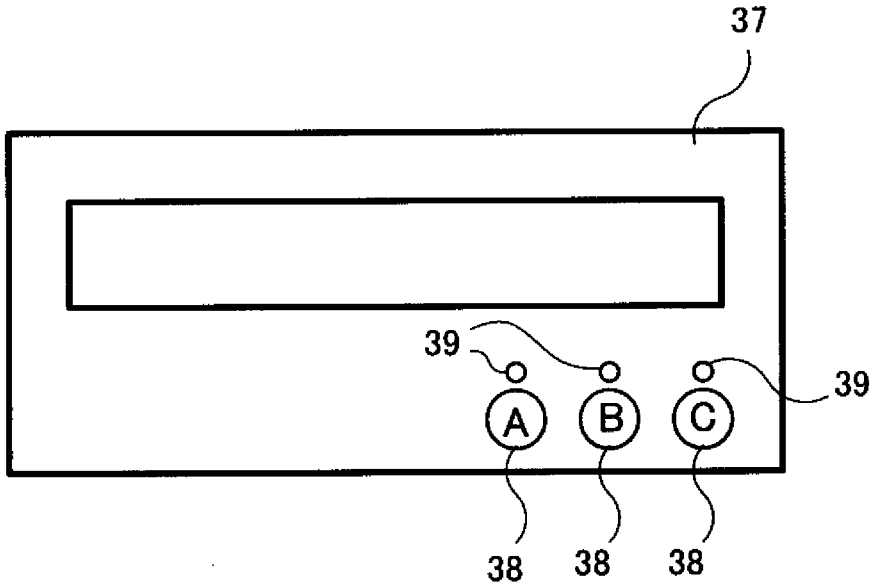
FIG. 3 is a schematic diagram illustrating a display and paper thickness buttons in the printing apparatus according to the first embodiment.

FIG. 3 shows the display unit 37 and the sheet thickness buttons 38.

A display such as an LCD is provided in a central portion of the display unit 37, and displays a run-out of sheet, a sheet jam, and error descriptions of the printing apparatus 10. Below the display, the sheet thickness buttons 38 are provided. The sheet thickness buttons 38 provided are three types, A, B, and C as shown in FIG. 3. Before starting the printing, an operator using the printing apparatus 10 sets the thickness of the sheet 11 currently loaded in the printing apparatus 10, and presses one of A, B, and C according to the thickness. In the embodiment, the A button corresponds to a small thickness, the B button corresponds to an ordinary thickness, and the C button corresponds to a large thickness.

LED lamps 39 are provided above the sheet thickness buttons 38. Only an LED lamp above a currently selected button illuminates, so that a sheet thickness currently selected can be recognized by the operator.

Figure 4:
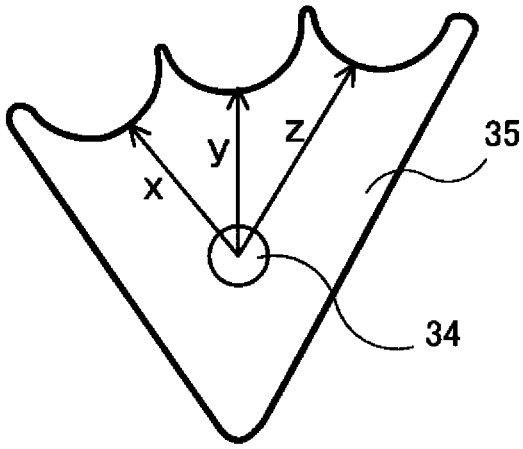
FIG. 4 is a diagram of a guide cam disposed in the printing apparatus according to the first embodiment.

FIG. 4 shows the shape of the guide cam 35. The guide cam 35 is provided with the rotational center 34 around which the guide cam 35 rotates. The guide cam 35 has three recesses as a cam surface. Distances between positions in the recesses to which the guide circular disc 35 contacts and the rotational center 34 are x, y, and z ($x<y<z$), respectively.

Next, the operation of the printing apparatus 10 will be described.

An operator using the printer sets the thickness of the sheet 11 currently loaded in the printing apparatus 10, and presses the A button of the sheet thickness buttons 38 when a sheet thickness is small, the B button when the sheet has an ordinary thickness, or the C button when the sheet thickness is large. In the following description, the operator is assumed to set the ordinary thickness as the sheet thickness and press the B button of the sheet thickness buttons 38.

When the B button of the sheet thickness buttons 38 is pressed, the printing apparatus 10 causes the driver 60 to output a drive signal to the motor (not shown) to rotate the guide cam 35 into a position at which a second recess of the recesses at the distance y from the rotation center 34 in FIG. 4 contacts the guide circular disc 36. This state is shown in FIG. 1. The upper sheet guide 22 at that time is shown by a solid line in FIG. 1.

Then, according to the programs stored in the ROM 54, the controller 50 performs the sheet feeding and printing operations.

First, a front end of the sheet 11 is drawn out and passed through the idle roller 13, and then set to be located between the thermal printing head 16 and the platen roller 14. When a printing request from the host computer 51 is input in this state, the controller 50, in response to the printing request, controls the printing unit 17 to print an image corresponding to printing data transmitted from the host computer 51 on the sheet 11. The printing is performed under cooperation between the thermal printing head 16 and the platen roller 14. The portion of the sheet 11 printed by the thermal printing head 16 is fed to the cutter 18 in accordance with the rotation of the platen roller 14. At this time, the feed roller 23 rotates in an X direction in FIG. 1.

The printed portion of the sheet 11 is inserted into the slit (not shown) between the stationary blade 19 and the movable blade 20, and then is passed through the cutter 18, and is fed toward the upper sheet guide 22. The front end of the fed sheet 11 touches the first guide portion **22*a* of the upper sheet guide 22**, which is formed in a flat shape.

Figure 5:
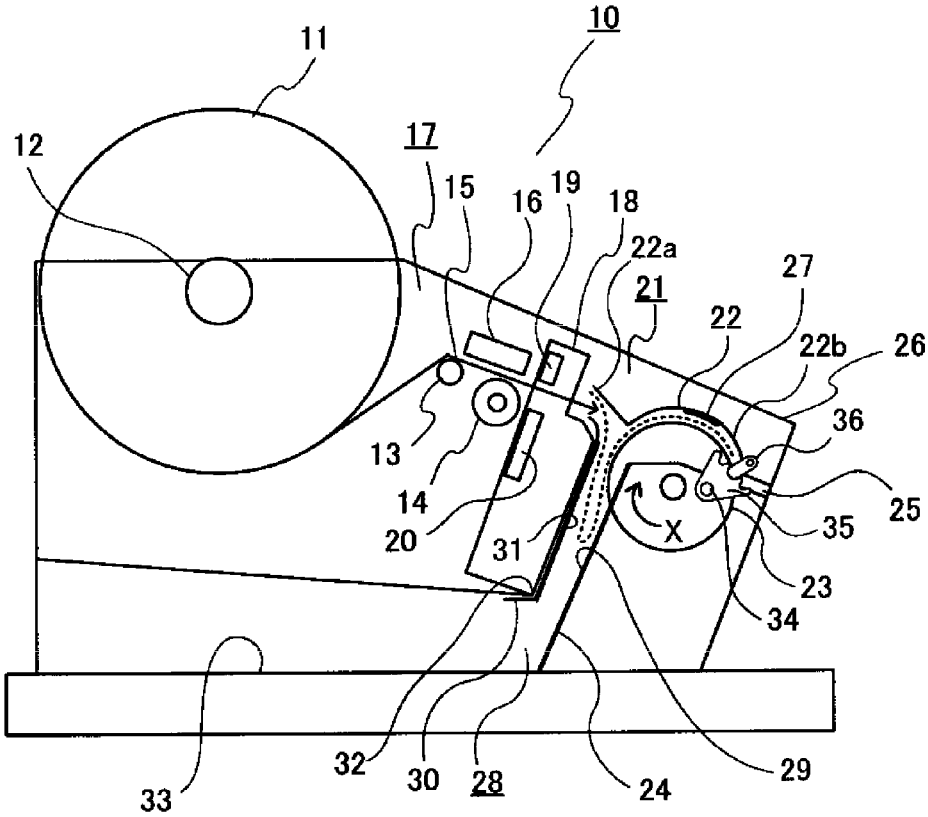
FIG. 5 is a diagram illustrating a sheet extending in the printing apparatus according to the first embodiment.

When the front end of the sheet 11 reaches a position at which the sheet is nipped between the protruding portion 27 and the feed roller 23, the feed roller 23 stops its rotation. However, the platen roller 14 continues rotating. Therefore, while the front end of the sheet 11 stands still, the backward portion of the sheet 11 continues to be fed. Thereby, the portion of the sheet 11 fed out of the cutter 18 turns in a loop shape within a space between the lower sheet guide 24 and the side sheet guide 30, as shown in FIG. 5.

Herein described is a method for creating a loop by stopping the rotation of the feed roller 23 when the front end of the sheet 11 reaches the position at which it is nipped between the protruding portion 27 and the feed roller 23. However, the front end of the sheet does not necessarily need to be held still at the position. By setting the feed speed of the sheet 11 at a portion nipped between the feed roller 23 and the protruding portion 27 provided on the upper sheet guide 22 lower than the feed speed of the sheet 11 by the platen roller 14, the difference in speed may lead to form the loop.

In forming a loop, when the loop becomes long, the loop enters the loop retraction space 28 provided in a lower part of the printing apparatus 10.

When specified printing on the sheet 11 is completed in this manner, the driver 58 of the controller 50 causes the cutter 18 to cut the sheet 11. Then, the driver 59 of the controller 50 causes the feed roller 23 to rotate in the X direction in FIG. 1. The rotation of the feed roller 23 causes the sheet 11 in the loop forming mechanism 21 to be ejected outside the ejection opening 25.

As for the kinds of sheet 11 used in the printing apparatus 10, there are various kinds such as a thick and resilient sheet, an ordinary-thickness sheet, and a thin less-resilient sheet. When the distance between the upper sheet guide 22 and the feed roller 23 is not changed based on the thickness of the sheet, the sheet 11 may be jammed, and a loop may not be formed properly. Thus, it is preferable to change the distance between the upper sheet guide 22 and the feed roller 23 based on the thickness of sheet.

Although description corresponds to a case where the sheet 11 loaded in the printing apparatus 10 has an ordinary thickness, when sheet 11 with a different thickness to be used thereafter is loaded, the operator of the printing apparatus 10 presses one of the sheet thickness buttons 38 most suitable for the thickness of the sheet 11 newly loaded.

The description hereinafter corresponds to a case where the sheet 11 has a small thickness.

When, of the sheet thickness buttons 38, the A button, which corresponds to small-thickness, is pressed, a drive signal to the motor (not shown) is output from the driver 60 to cause the guide cam 35 to rotate into a position at which a first recess of the recesses at the distance x from the rotation center 34 in FIG. 4 contacts the guide circular disc 36.

The upper sheet guide 22 is connected with the guide circular disc 36. The integral upper sheet guide 22 and guide circular disc 36 are urged toward the feed roller 23 by the urging mechanism (not shown).

When the thickness of the sheet 11 is an ordinary thickness, the cam surface having the distance y as shown in FIG. 4 is used and the distance between the feed roller 23 and the upper sheet guide 22 is controlled accordingly. When the thickness of the sheet 11 is small, the cam surface having the distance x as shown in FIG. 4 is used and the distance between the feed roller 23 and the upper sheet guide 22 is controlled accordingly. Since x is smaller than y, the distance between the feed roller 23 and the upper sheet guide 22 for the sheet 11 having a smaller thickness is smaller by y minus x than that for the sheet 11 having an ordinary thickness.

This state is shown in FIG. 1. When the thickness of the sheet 11 is small, the position of the upper sheet guide 22 is in a position 22' shown by a broken line in FIG. 1. (As for the guide cam 35, the position after the change is not shown)

Similarly, when the sheet is thick, the guide cam 35 is caused to rotate into a position at which a third recess of the recesses at the distance z from the rotation center 34 touches the guide circular disc 36 as shown in FIG. 4.

In this manner, a variable mechanism is provided for varying the distance of a space between the feed roller 23 and the upper sheet guide 22 constituting a sheet feeding path, based on the setting corresponding to the sheet thickness. As a result, the sheet 11 may be prevented from being jammed on the sheet feeding path 15 even when the sheet used is replaced with a sheet having a different thickness. Even when any thickness of sheet is used, sheet to be ejected may be kept in the printing apparatus by bending the sheet in a loop shape until the printing and cutting of the sheet are completed, and the sheet may be ejected to a receiver after the cutting of the sheet.

Second Embodiment

Figure 6:
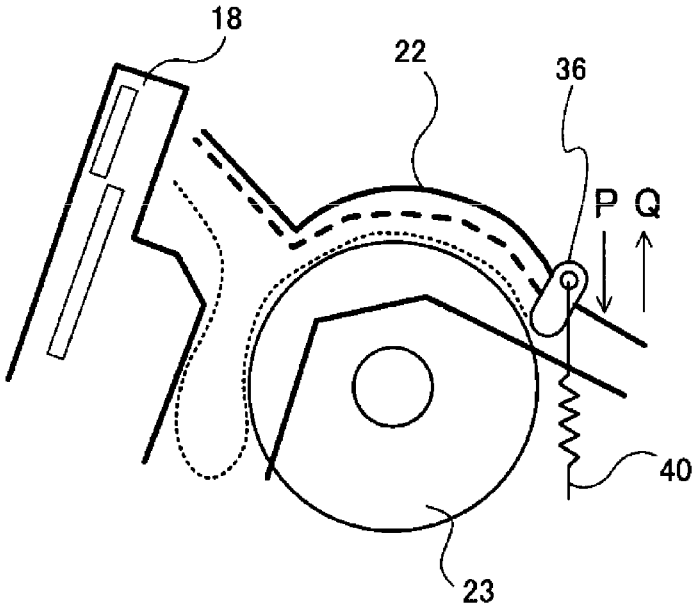
FIG. 6 is a schematic diagram illustrating components of a printing apparatus according to a second embodiment.

FIG. 6 shows components of a printing apparatus according to a second embodiment. FIG. 6 is an enlarged view of a feed roller 23 and an upper sheet guide 22. In the second embodiment, different from the first embodiment where setting information related to the sheet thickness is obtained and a guide cam 35 rotates based on the setting information, a guide circular disc 36 and a frame (not shown) are coupled by a spring 40.

Various kinds of sheets 11 with various thicknesses may be used in a printing apparatus 10. When the thickness is large, the sheet is resilient, and a pressing force with which the sheet presses a component that the sheet contacts during feeding is large.

When the guide circular disc 36 is connected to the frame (not shown) with the spring 40, the guide circular disc 36 and the upper sheet guide 22 connected therewith are urged in a P direction in FIG. 6 by the spring 40. In this state, the sheet 11 is fed, and a front end portion of the sheet 11 contacts the guide circular disc 36.

When the thickness of the sheet 11 is small, the pressing force of the sheet 11 is small, and thus the guide circular disc 36 moves little in a Q direction in FIG. 6. However, as the thickness of the sheet 11 becomes larger, the pressing force of the sheet pressing the guide circular disc 36 becomes larger, and thereby the guide circular disc 36 largely moves in the Q direction.

Accordingly, without obtaining the setting information on sheet thickness, the distance between the upper sheet guide 22 and the feed roller 23 is changed in accordance with the pressing force of the sheet 11 pressing the guide circular disc 36. As a result, the sheet 11 may be prevented from being jammed along the sheet feeding path 15. With respect to various types of sheets having different thickness, the sheet to be ejected may be kept in the printing apparatus by bending the sheet in a loop shape until the printing and cutting of the sheet are completed, and the sheet can be ejected to a receiver after the cutting of the sheet.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printing apparatus comprising:

a platen roller configured to convey a sheet;

a printing head disposed opposite the platen roller;

a cutter configured to cut the sheet conveyed from the platen roller;

a sheet guide disposed so as to guide a portion of the sheet that has passed the cutter;

a feed roller configured to rotate and convey the sheet from the cutter between the feed roller and the sheet guide and stop rotating when a portion of the sheet is nipped between the feed roller and the sheet guide; and an adjusting mechanism configured to set a distance between the sheet guide and the feed roller.

2. The printing apparatus according to claim 1, further comprising:

a controller configured to control the adjusting mechanism to set the distance in response to a user input.

3. The printing apparatus according to claim 2, wherein a thickness of the sheet is selected by the user input, and the controller sets the distance in accordance with the selected thickness.

4. The printing apparatus according to claim 1, wherein the adjusting mechanism includes a cam that is configured to set the distance.

5. The printing apparatus according to claim 1, wherein the sheet guide has a protruding portion that protrudes towards the feed roller, and the portion of the sheet is nipped between the protruding portion and the feed roller.

6. The printing apparatus according to claim 5, wherein the distance set by the adjusting mechanism is a distance between the protruding portion of the sheet guide and the feed roller.

7. The printing apparatus according to claim 1, wherein the adjusting mechanism is configured to set the distance in accordance with a thickness of the sheet.

8. The printing apparatus according to claim 7, wherein the adjusting mechanism includes an urging member urging the sheet guide towards the feed roller and a protruding member that protrudes from the sheet guide towards the feed roller, wherein the sheet guide is moved away from the feed roller when a front end of the sheet contacts the protruding member.

9. The printing apparatus according to claim 1, wherein the adjusting mechanism is configured to set the distance in accordance with a stiffness of the sheet.

10. A sheet ejecting apparatus configured to eject a sheet conveyed from a printer, comprising:

a sheet guide disposed so as to guide the sheet conveyed from the printer;

a feed roller configured to rotate and convey the sheet from the printer between the feed roller and the sheet guide and stop rotating when a portion of the sheet is nipped between the feed roller and the sheet guide; and an adjusting mechanism configured to set a distance between the sheet guide and the feed roller.

11. The sheet ejecting apparatus according to claim 10, further comprising:

a controller configured to control the adjusting mechanism to set the distance in response to a user input.

12. The sheet ejecting apparatus according to claim 10, wherein a thickness of the sheet is selected by the user input, and the controller sets the distance in accordance with the selected thickness.

13. The sheet ejecting apparatus according to claim 10, wherein the adjusting mechanism includes a cam that is configured to set the distance.

14. The sheet ejecting apparatus according to claim 10, wherein the sheet guide has a protruding portion that protrudes towards the feed roller, and the portion of the sheet is nipped between the protruding portion and the feed roller.

15. The sheet ejecting apparatus according to claim 10, wherein the distance set by the adjusting mechanism is a distance between the protruding portion of the sheet guide and the feed roller.

16. A method for operating a printing apparatus, comprising:

printing an image on a sheet;

conveying the sheet on which the image is printed with a platen roller;

guiding the sheet on which the image is printed between a sheet guide and a feed roller;

rotating the feed roller to convey the sheet between the sheet guide and the feed roller;

stopping the rotation of the feed roller when a portion of the sheet is nipped between the sheet guide and the feed roller; and cutting the sheet;

wherein a distance between the sheet guide and the feed roller is adjustable.

17. The method according to claim 16, further comprising:

receiving a user input; and adjusting the distance between the sheet guide and the feed roller in accordance with the user input.

18. The method according to claim 16, further comprising:

adjusting the distance between the sheet guide and the feed roller in accordance with a thickness of the sheet.

19. The method according to claim 16, further comprising:

adjusting the distance between the sheet guide and the feed roller in accordance with a stiffness of the sheet.

* * * * *